US009930937B2

(12) United States Patent
Nanbu et al.

(10) Patent No.: US 9,930,937 B2
(45) Date of Patent: Apr. 3, 2018

(54) BUCKLE

(75) Inventors: Madoka Nanbu, Toyama (JP); Yuu Hashimoto, Toyama (JP)

(73) Assignee: YKK Corporation (JP)

( * ) Notice: Subject to any disclaimer, the term of this patent is extended or adjusted under 35 U.S.C. 154(b) by 350 days.

(21) Appl. No.: 14/410,922

(22) PCT Filed: Jun. 28, 2012

(86) PCT No.: PCT/JP2012/066603
§ 371 (c)(1),
(2), (4) Date: Dec. 23, 2014

(87) PCT Pub. No.: WO2014/002235
PCT Pub. Date: Jan. 3, 2014

(65) Prior Publication Data

US 2015/0143675 A1 May 28, 2015

(51) Int. Cl.
*A44B 11/25* (2006.01)
*A44B 11/26* (2006.01)

(52) U.S. Cl.
CPC ..... *A44B 11/2592* (2013.01); *A44B 11/266* (2013.01); *Y10T 24/45958* (2015.01)

(58) Field of Classification Search
CPC ..... A44B 11/266; A44B 11/2592; Y10T 24/45534; Y10T 24/45785; Y10T 24/45581; Y10T 24/45529; Y10T 24/45524; Y10T 24/45623; Y10T 24/45702; Y10T 24/45864; Y10T 24/4556; Y10T 24/45958
See application file for complete search history.

(56) References Cited

U.S. PATENT DOCUMENTS 5,465,472 A * 11/1995 Matoba ..... A44B 11/266 24/616
5,671,516 A * 9/1997 Sartori ..... A44B 11/2515 24/579.11
6,421,889 B1 7/2002 Chien
7,979,966 B2 7/2011 Yoshie

FOREIGN PATENT DOCUMENTS

JP 7-289310 A 11/1995
JP 984098 S 7/1997
JP 4174561 B2 8/2008
JP 2009-61050 A 3/2009

OTHER PUBLICATIONS

International Search Report, PCT Application No. PCT/JP2012/066603, dated Aug. 7, 2012.
Written Opinion of the International Searching Authority, PCT Application No. PCT/JP2012/066603, dated Aug. 7, 2012.

* cited by examiner

*Primary Examiner* — Jack W Lavinder
(74) *Attorney, Agent, or Firm* — Kilpatrick Townsend & Stockton LLP

(57) ABSTRACT

There is provided a buckle including a plug and a socket. The plug includes a plug-side base part, a pair of leg parts, and a pair of engagement protrusions. The socket includes a socket-side base part, an upper plate, a lower plate, upper side wall parts, lower side wall parts, engagement stepped portions, slits, and guide surfaces. A dimension of the pair of engagement protrusions in the upward and downward direction is set to be greater than a dimension of each of the slits in the width direction.

5 Claims, 15 Drawing Sheets

BUCKLE

This application is a national stage application of PCT/JP2012/066603, which is incorporated herein by reference.

TECHNICAL FIELD

The present invention relates to a buckle having a plug and a socket configured to be engaged and disengaged each other, and configured to connect and disconnect end portions of a belt-shaped member.

BACKGROUND ART

A buckle of the related art has been known which has a plug and a socket configured to be engaged and disengaged each other, the plug having a guide rod formed along a plug insertion line and the socket having a guide part formed along the plug insertion line and configured to guide the guide rod (for example, refer to Patent Documents 1 and 2).

PRIOR ART DOCUMENT

Patent Document

[Patent Document 1] U.S. Pat. No. 6,421,889B
[Patent Document 2] Japanese Patent No. 4,174,561B

SUMMARY OF INVENTION

Problems to Be Solved by Invention

According to the buckle disclosed in Patent Documents 1 and 2, since the guide rod and the guide part are formed along the plug insertion line, the plug should be inserted straightly along the plug insertion line. If the plug is inserted obliquely relative to the plug insertion line, the plug cannot be inserted into the socket.

It is therefore an object of the present invention to provide a buckle enabling a plug to be easily inserted into a socket even if the plug is inserted obliquely relative to a plug insertion line.

Means for Solving Problems

The above object of the present invention is accomplished by following configurations.

(1) There is provided a buckle including a plug and a socket configured to insert the plug therethrough to be engaged with the plug, wherein the plug includes: a plug-side base part to which a belt-shaped member is attached; a pair of leg parts extending in parallel each other from both end portions of the plug-side base part in a width direction; and a pair of engagement protrusions protruding in an upward and downward direction from each of leading end portions of the pair of leg parts, wherein the socket includes: a socket-side base part to which the belt-shaped member is attached; an upper plate and a lower plate extending from the socket-side base part; upper side wall parts protruding downwardly along both side edges of the upper plate in the width direction; lower side wall parts protruding upwardly along both side edges of the lower plate in the width direction; engagement stepped portions capable of being respectively engaged with the pair of engagement protrusions of the pair of leg parts inserted between the upper and lower plates; slits formed between the upper side wall parts and the lower side wall parts and each having an end portion opened at a plug insertion-side so that the pair of leg parts can be inserted therein; and guide surfaces formed on inner surfaces of the upper side wall parts and the lower side wall parts and configured to guide the pair of engagement protrusions of the pair of leg parts inserted between the upper and lower plates to the engagement stepped portions, and wherein a dimension of the pair of engagement protrusions in the upward and downward direction is set to be greater than a dimension of each of the slits in the width direction.

(2) In the configuration of (1), each of the leg parts has an outer leg part and an inner leg part, and a dimension of the inner leg part in the upward and downward direction is set to be greater than the dimension of each of the slits in the width direction.

(3) In the configuration of (2), an operation part is formed from a base end portion to an intermediate part of the outer leg part, and a dimension of the operation part in the upward and downward direction is set to be greater than a dimension between the upper and lower plates in the upward and downward direction.

(4) In the configuration of any one of (1) to (3), the plug includes a fitting rod arranged between the pair of leg parts and formed in parallel with the pair of leg parts, and the socket includes a fitting hole arranged between the upper and lower plates and into which the fitting rod is fitted.

(5) In the configuration of (3), the outer leg part is formed with a slit insertion part configured to be inserted into the slit of the socket.

(6) In the configuration of (1) or (4), inner surfaces of the upper and lower plates of the socket are formed to be gradually narrowed towards the socket-side base part.

(7) There is provided a buckle including a plug and a socket configured to be engaged with the plug, wherein the plug includes: a plug-side base part to which a belt-shaped member is attached; a pair of leg parts extending in parallel each other from both end portions of the plug-side base part in a width direction; and a pair of engagement protrusions protruding in an upward and downward direction from each of leading end portions of the pair of leg parts, wherein the socket includes: a socket-side base part to which the belt-shaped member is attached; an upper plate and a lower plate extending from the socket-side base part; upper side wall parts protruding downwardly along both side edges of the upper plate in the width direction; lower side wall parts protruding upwardly along both side edges of the lower plate in the width direction; engagement stepped portions capable of being respectively engaged with the pair of engagement protrusions of the pair of leg parts inserted between the upper and lower plates; slits formed between the upper side wall parts and the lower side wall parts and each having an end portion opened at a plug insertion-side so that the pair of leg parts can be inserted therein; and guide surfaces formed on inner surfaces of the upper side wall parts and the lower side wall parts and configured to guide the pair of engagement protrusions of the pair of leg parts inserted between the upper and lower plates to the engagement stepped portions, and wherein when the plug is inserted into the socket, the engagement protrusions of the leg parts of the plug comes into contact with and are guided by the guide surfaces of the socket.

(8) In the configuration of (7), each of the leg parts has an outer leg part and an inner leg part, and an outer surface of the inner leg part is configured to come into contact with and be guided by the upper side wall part and lower side wall part of the socket.

(9) In the configuration of (7) or (8), each of the leg parts has an outer leg part and an inner leg part, and an inner surface of the outer leg part is configured to come into contact with and be guided by outer surfaces of the upper plate and lower plate of the socket.

(10) In the configuration of (7), when the plug is inserted into the socket, a guidance by the engagement protrusions of the leg parts of the plug and the guide surfaces of the socket, a guidance by outer surfaces of inner leg parts and the upper side wall parts and lower side wall parts of the socket and a guidance by inner surfaces of outer leg parts of the plug and outer surfaces of the upper plate and lower plate of the socket are continuously made.

Advantageous Effects of Invention

According to the buckle of the present invention, the plug includes the pair of engagement protrusions protruding in the upward and downward direction from each of the leading end portions of the pair of leg parts, the socket includes the upper side wall parts protruding downwardly along both side edges of the upper plate in the width direction, the lower side wall parts protruding upwardly along both side edges of the lower plate in the width direction, the slit formed between the upper side wall parts and the lower side wall parts and having an end portion opened at a plug insertion-side so that the pair of leg parts can be inserted therein, and the guide surfaces formed on the inner surfaces of the lower side wall parts and the lower side wall parts and configured to guide the pair of engagement protrusions of the pair of leg parts inserted between the upper and lower plates to the engagement stepped portions, and the dimension of the pair of engagement protrusions in the upward and downward direction is set to be greater than the dimension of the slit in the width direction. Therefore, even if the plug is inserted obliquely relative to a plug insertion line, since the pair of engagement protrusions of the one leg part of the plug comes into contact with and is guided by the guide surfaces of the upper side wall part and lower side wall part of the socket, a direction of the plug is adjusted to follow the plug insertion line.

Also, according to the buckle of the present invention, the dimension of the inner leg part of the plug in the upward and downward direction is set to be greater than the dimension of the slit in the width direction. Thereby, even if the plug is inserted obliquely relative to the plug insertion line, an outer surface of the inner leg part of the one leg part of the plug comes into contact with and is guided by end portions of the upper side wall part and lower side wall part of the socket. Therefore, since the direction of the plug is adjusted to follow the plug insertion line, it is possible to further easily insert the plug into the socket.

Also, according to the buckle of the present invention, the dimension of the operation part of the outer leg part in the upward and downward direction is set to be greater than the dimension between the upper plate and the lower plate in the upward and downward direction. Thereby, even if the plug is inserted obliquely relative to the plug insertion line, an inner surface of the outer leg part of the one leg part of the plug comes into contact with and guided by the outer surfaces of the upper plate and lower plate of the socket. Therefore, since the direction of the plug is adjusted to follow the plug insertion line PL, it is possible to further easily insert the plug into the socket.

Also, according to the buckle of the present invention, the plug has the fitting rod arranged between the pair of leg parts and formed in parallel with the pair of leg parts, and the socket has the fitting hole arranged between the upper plate and the lower plate and to which the fitting rod is fitted. Therefore, upon engagement of the buckle, it is possible to prevent the plug and the socket from rattling in the upward and downward direction and in the width direction.

Also, according to the buckle of the present invention, the inner surfaces of the upper and lower plates of the socket are formed to be gradually narrowed towards the socket-side base part. Therefore, it is possible to widen the end portions of the upper and lower plates at the plug insertion-side, so that it is possible to improve an insertion ability of the plug.

EMBODIMENTS OF INVENTION

Figure 1:
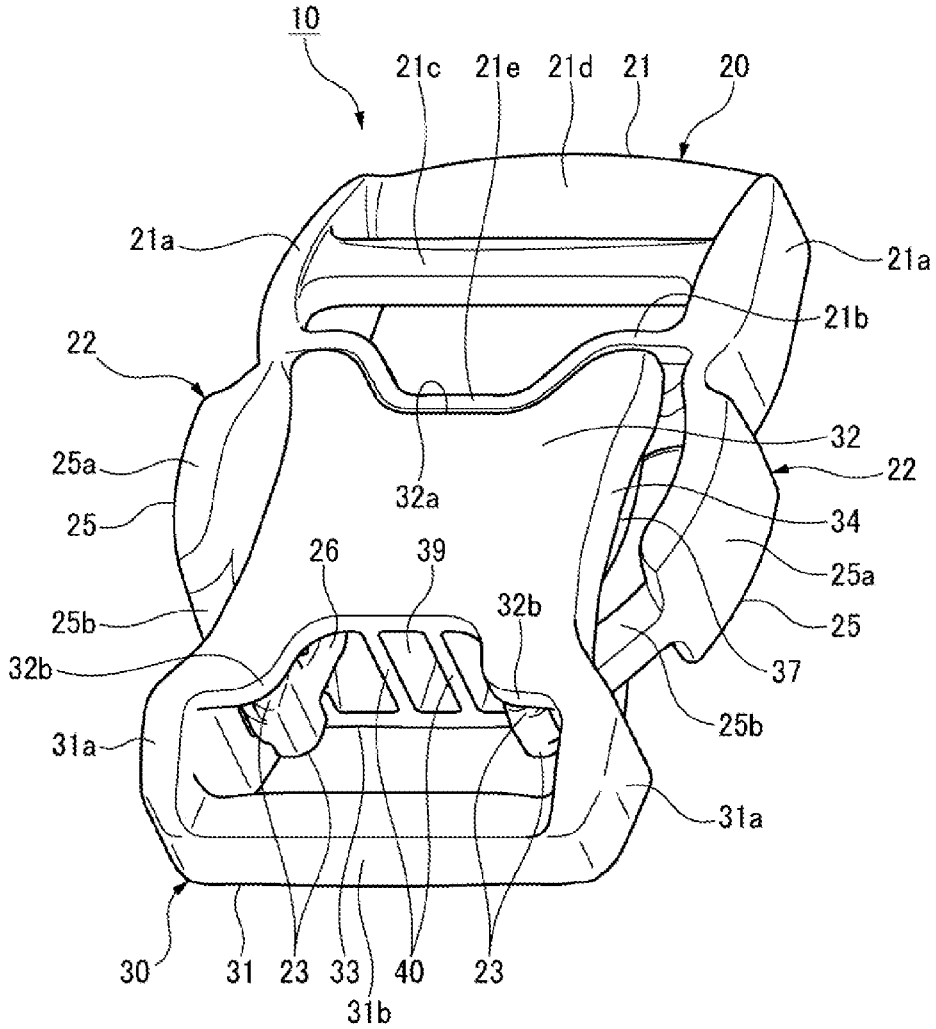
FIG. 1 is a perspective view of a buckle at an engaged state according to a first illustrative embodiment of the present invention.
Figure 2:
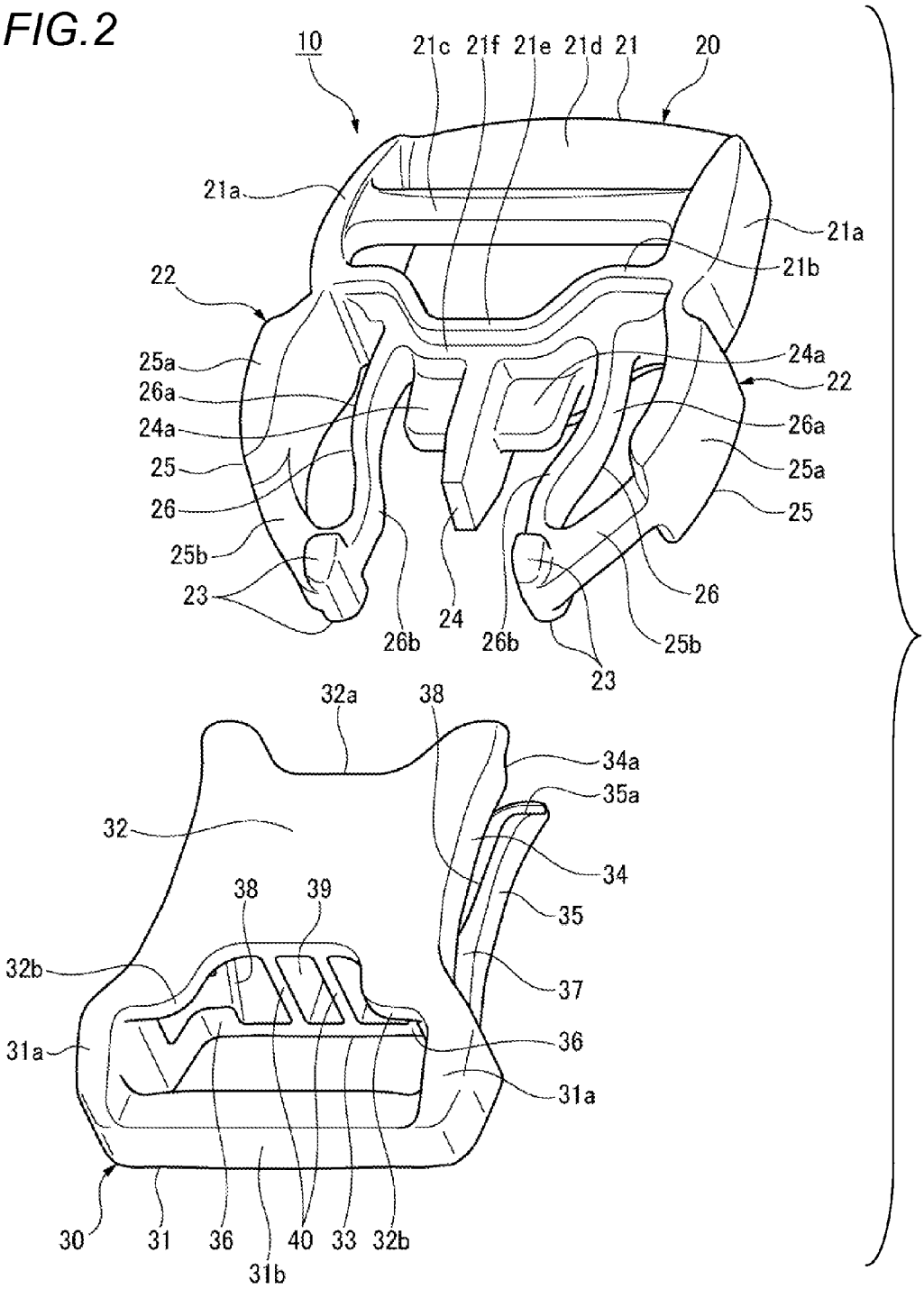
FIG. 2 is a perspective view of the buckle shown in FIG. 1 at a disengaged state.

Hereinafter, an illustrative embodiment of the buckle of the present invention will be described in detail with reference to the drawings. In below descriptions, regarding the buckle, an upper side refers to a front side with respect to the sheet of FIG. 3, a lower side refers to an inner side with respect to the sheet of FIG. 3, a right side refers to a right side with respect to the sheet of FIG. 3 and a left side refers to a left side with respect to the sheet of FIG. 3. A left-right direction of the buckle is also referred to as a width direction.

As shown in FIGS. 1 to 4, a buckle 10 of this illustrative embodiment has a plug 20 and a socket 30 configured to insert the plug 20 therethrough to be engaged with the plug 20. The plug 20 and the socket 30 are formed by an injection molding of a synthetic resin. Also, the plug 20 and the socket 30 may be made of metal, instead of the synthetic resin. In the meantime, a reference numeral PL in the drawings indicates a plug insertion line when the plug 20 is inserted along a central line of the socket 30 in the width direction.

Figure 4:
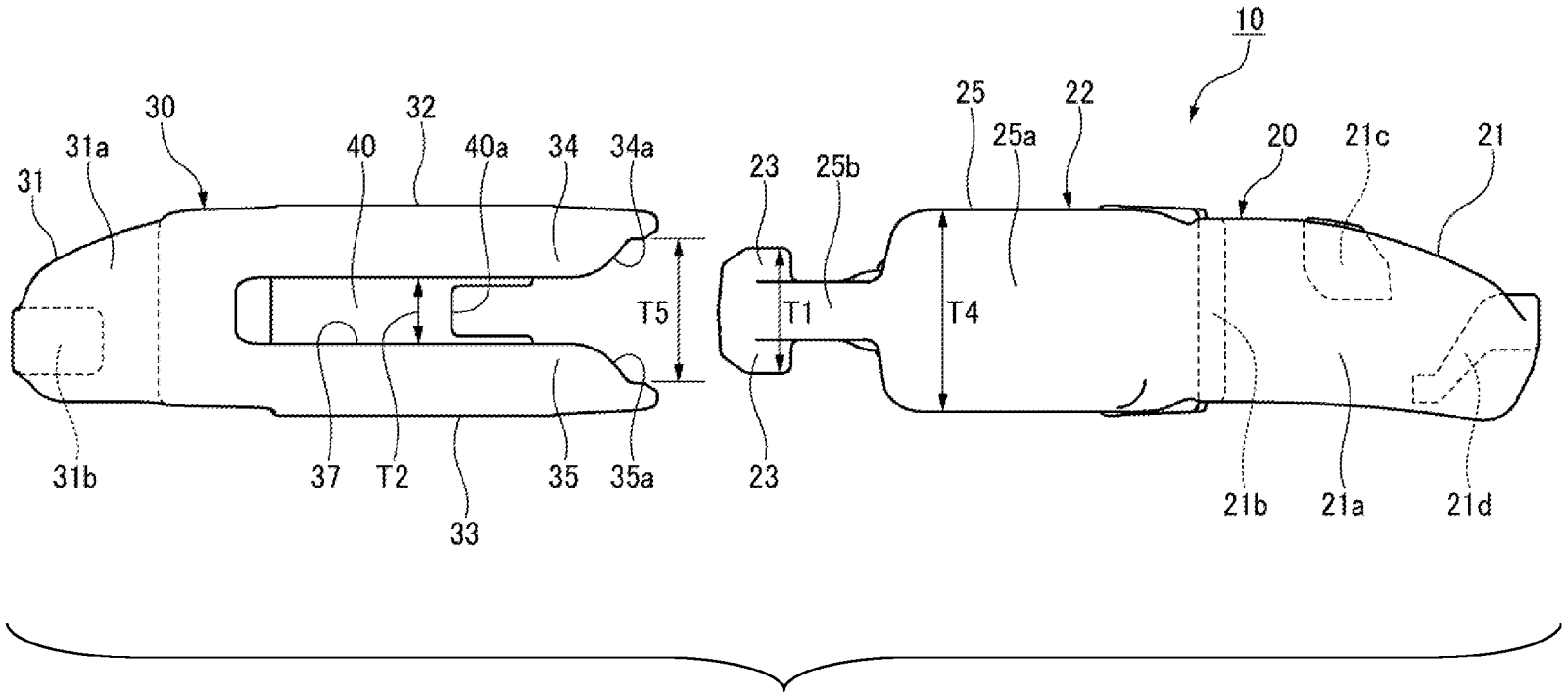
FIG. 4 is a right side view of the buckle at the disengaged state.
Figure 5:
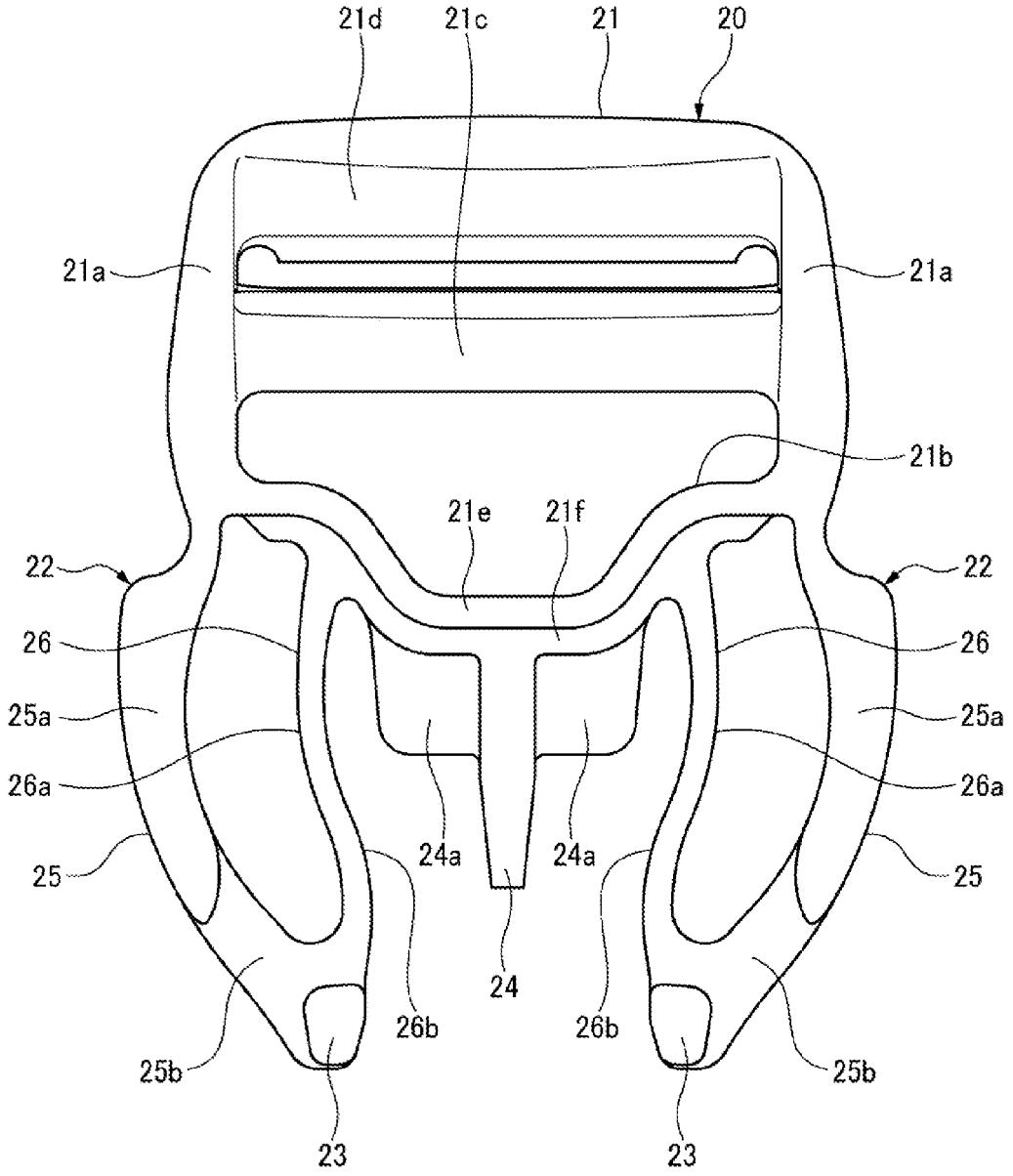
FIG. 5 is a plan view of a plug shown in FIG. 2.
Figure 6:
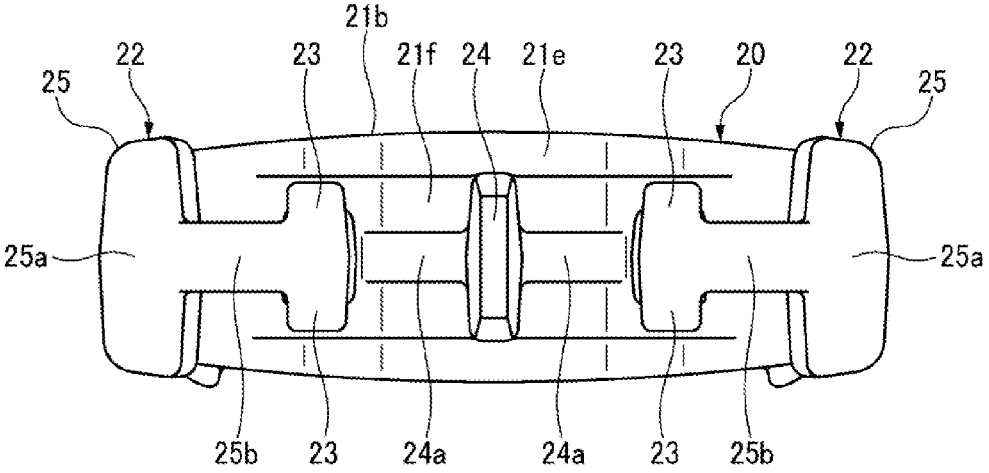
FIG. 6 is a view of the plug shown in FIG. 5, as seen from a pair of leg parts.

As shown in FIGS. 4 to 6, the plug 20 has a plug-side base part 21 to which a belt-shaped member is attached, a pair of right and left leg parts 22 extending in parallel each other from both end portions of the plug-side base part 21 in the width direction, a pair of engagement protrusions 23 protruding in an upward and downward direction from each of leading end portions of the pair of right and left leg parts 22, and a fitting rod 24 arranged at a central part in the width direction between the pair of right and left leg parts 22 and formed in parallel with the pair of right and left leg parts 22.

The plug-side base part 21 has a pair of right and left side surface plates 21*a* and first to third connection rods 21*b* to 21*d* configured to connect the pair of right and left side surface plates 21*a* in the width direction. The first connection rod 21*b* arranged to be closest to the socket 30 is formed with the pair of right and left leg parts 22 and the fitting rod 24.

Also, as shown in FIGS. 5 and 6, the first connection rod 21*b* is formed at a central portion thereof in the width direction with a convex part 21*e* protruding towards the socket 30 and having a trapezoidal shape as seen from above. Further, the first connection rod 21*b* is formed with a protrusion 21*f* protruding towards the socket 30 over a substantial entire length thereof in the width direction. The protrusion 21*f* is fitted with end portion inner surfaces of upper and lower plates 32, 33 of the socket 30 (which will be described later) at a plug insertion-side upon engagement of the buckle (refer to FIGS. 10 to 12). Thereby, the rattling of the plug 20 and the socket 30 in the upward and downward direction is prevented.

Each of the leg parts 22 can be elastically deformed in the width direction, and has an outer leg part 25 and an inner leg part 26 arranged at an inner side of the outer leg part 25 in the width direction and having a leading end portion connected to a leading end portion of the outer leg part 25, as shown in FIG. 5. Also, a plate thickness of the inner leg part 26 in the width direction is set to be smaller than a plate thickness of the outer leg part 25 in the width direction. Also, a hole penetrating the leg part 22 in the upward and downward direction is formed between the outer leg part 25 and the inner leg part 26.

The outer leg part 25 has a shape that is gently curved inwardly in the width direction as it faces from a base end portion towards the leading end portion. Also, an operation part 25*a* is formed from a base end portion to an intermediate part of the outer leg part 25. The operation part 25*a* is wide in the upward and downward direction and has a substantially rectangular shape, as seen from the side. Also, upper and lower surfaces of the leading end portion of the outer leg part 25 are formed with a pair of engagement protrusions 23, respectively. Also, a slit insertion part 25*b* configured to be inserted into slits 37 of the socket 30 (which will be described later) is configured between the operation part 25*a* of the outer leg part 25 and the pair of engagement protrusions 23.

The inner leg part 26 has a first curved part 26*a* that is gently curved inwardly in the width direction as it faces from a base end portion towards an intermediate part, and a second curved part 26*b* that is gently curved outwardly in the width direction as it faces from the intermediate part towards the leading end portion, and is formed to have a substantial S-shape, as seen from above.

As shown in FIGS. 5 and 6, the fitting rod 24 is a plate-shaped member having a rectangular section and has a linear shape extending from a central portion of the plug-side base part 21 in the width direction. Also, the fitting rod 24 is formed at central portions of both side surfaces thereof in the upward and downward direction with protruding pieces 24*a* extending outwardly in the width direction, respectively. Also, the protruding pieces 24*a* are formed from the plug-side base part 21 to the intermediate part of the fitting rod 24 in the longitudinal direction. Also, upper, lower, right and left surfaces of the leading end portion of the fitting rod 24 are chamfered so that they are tapered towards the leading end portion.

Figure 7:
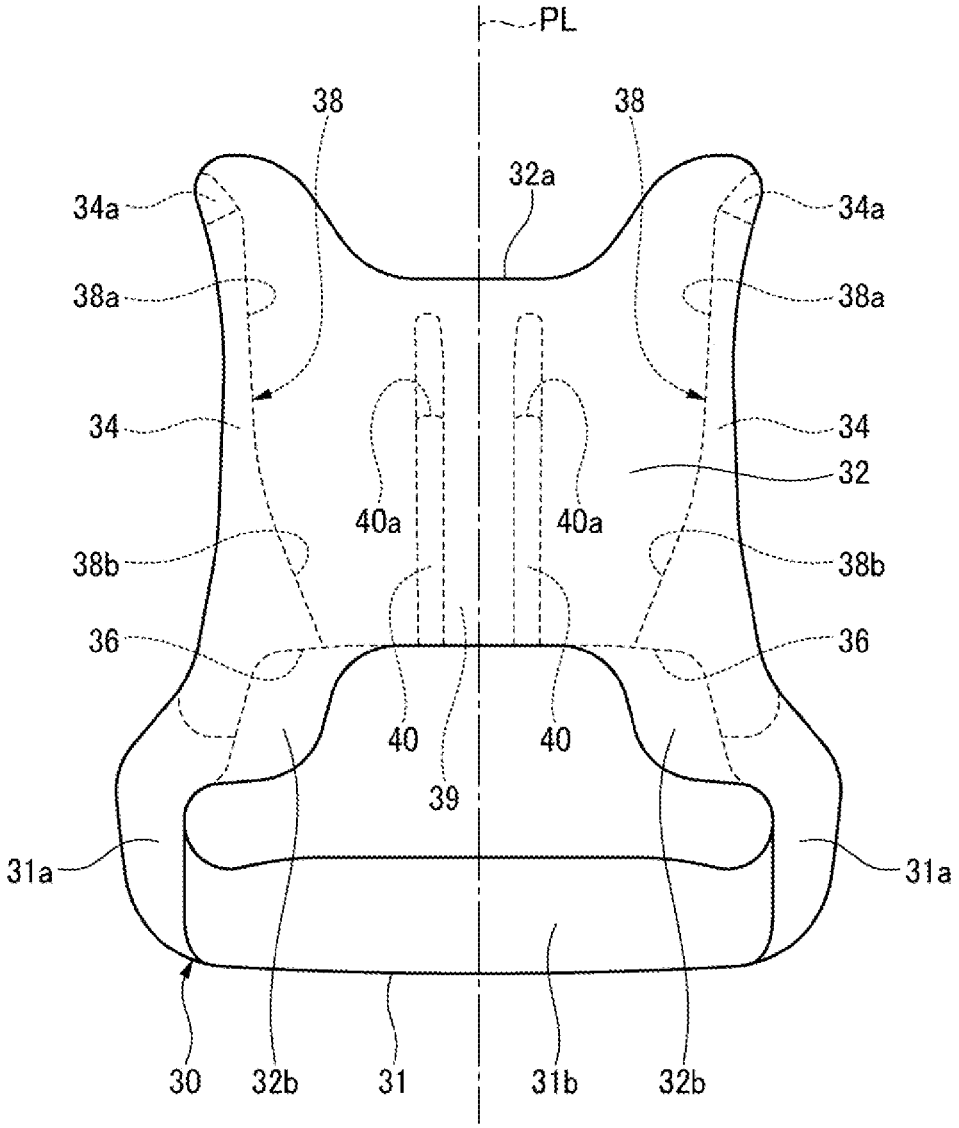
FIG. 7 is a plan view of a socket shown in FIG. 2.
Figure 8:
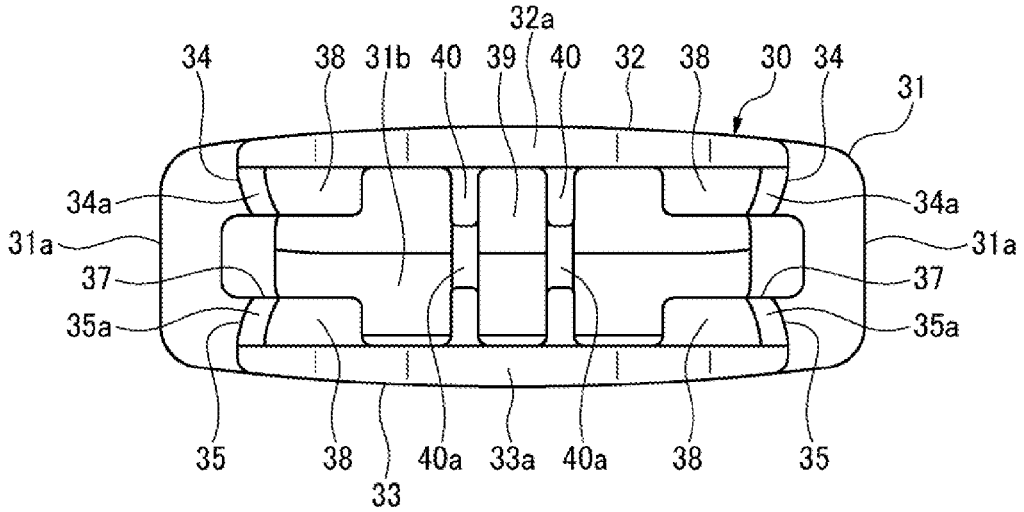
FIG. 8 is a view of the socket shown in FIG. 7, as seen from a plug insertion-side.

As shown in FIGS. 4, 7 and 8, the socket 30 has a socket-side base part 31 to which a belt-shaped member is attached, an upper plate 32 and a lower plate 33 extending from the socket-side base part 31, upper side wall pairs 34 protruding downwardly along both side edges of the upper plate 32 in the width direction, lower side wall parts 35 protruding upwardly along both side edges of the lower plate 33 in the width direction, engagement stepped portions 36 capable of being respectively engaged with the pair of engagement protrusions 23 of the pair of right and left leg parts 22 inserted between the upper plate 32 and the lower plate 33, slides 37 formed between the upper side wall parts 34 and the lower side wall parts 35 and each having an end portion opened at a plug insertion-side so that the pair of right and left leg parts 22 can be inserted therein, guide surfaces 38 formed on inner surfaces of the lower side wall parts 34 and the lower side wall parts 35 and configured to guide the pair of engagement protrusions 23 of the pair of right and left leg parts 22 inserted between the upper plate 32 and the lower plate 33 to the engagement stepped portions 36, and a fitting hole 39 arranged between the upper plate 32 and the lower plate 33 and into which the fitting rod 24 of the plug 20 is fitted.

The socket-side base part 31 has a pair of right and left side surface plates 31*a* and a connection rod 31*b* configured to connect the pair of right and left side surface plates 31*a* in the width direction. The upper plate 32 and the lower plate 33 are connected to the pair of right and left side surface plates 31*a*.

Figure 9:
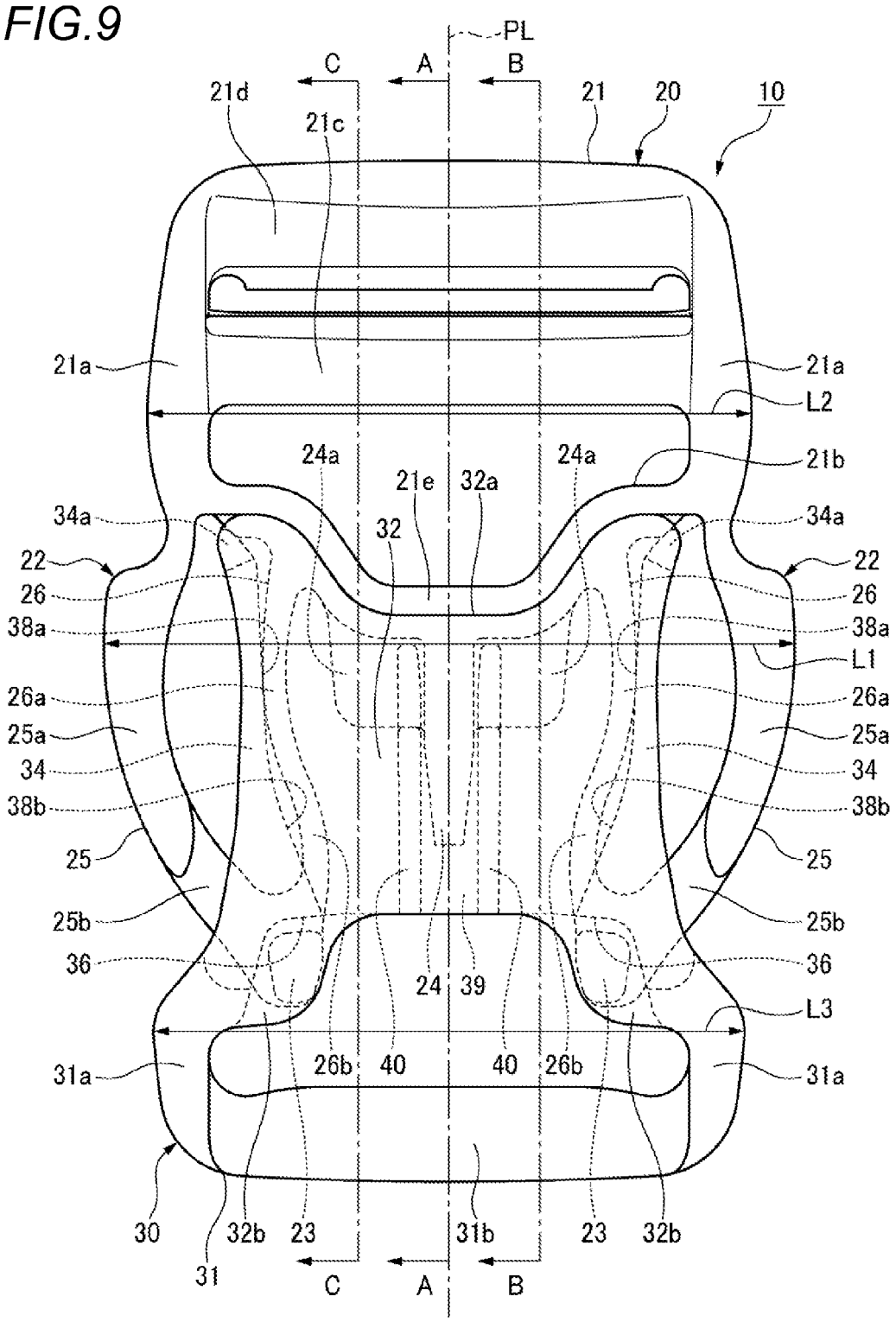
FIG. 9 is a plan view of the buckle at the engaged state.

As shown in FIG. 7, both side edges of the upper plate 32 and lower plate 33 in the width direction are formed to have a curved shape that is concave inwardly in the width direction, respectively. Also, as shown in FIG. 9, the operation parts 25*a* of the outer leg parts 25 of the plug 20 are arranged at outer sides of the side edges of the upper plate 32 and the lower plate 33 in the width direction, upon the engagement of the buckle.

Also, as shown in FIGS. 7 and 8, central portions of end faces of the upper plate 32 and lower plate 33 at the plug insertion-side are formed with concave parts 32*a*, 33*a* concave towards the socket-side base part 31 and having a trapezoidal shape as seen from above, respectively. Upon the engagement of the buckle, the convex part 21*e* of the first connection rod 21*b* of the plug-side base part 21 is fitted to the concave parts 32*a*, 33*a* (refer to FIGS. 9 and 10). Thereby, the rattling of the plug 20 and the socket 30 in the width direction is prevented.

As shown in FIG. 4, the upper side wall parts 34 and the lower side wall parts 35 are respectively formed over the substantial entire lengths of the side edges of the upper plate 32 and the lower plate 33 in the width direction. Also, the upper side wall parts 34 and the lower side wall parts 35 are respectively formed at end portions of the plug insertion-side thereof with inclined parts 34*a*, 35*a* configured to guide the pair of right and left leg parts 22 of the plug 22 to the slits 37.

Figure 3:
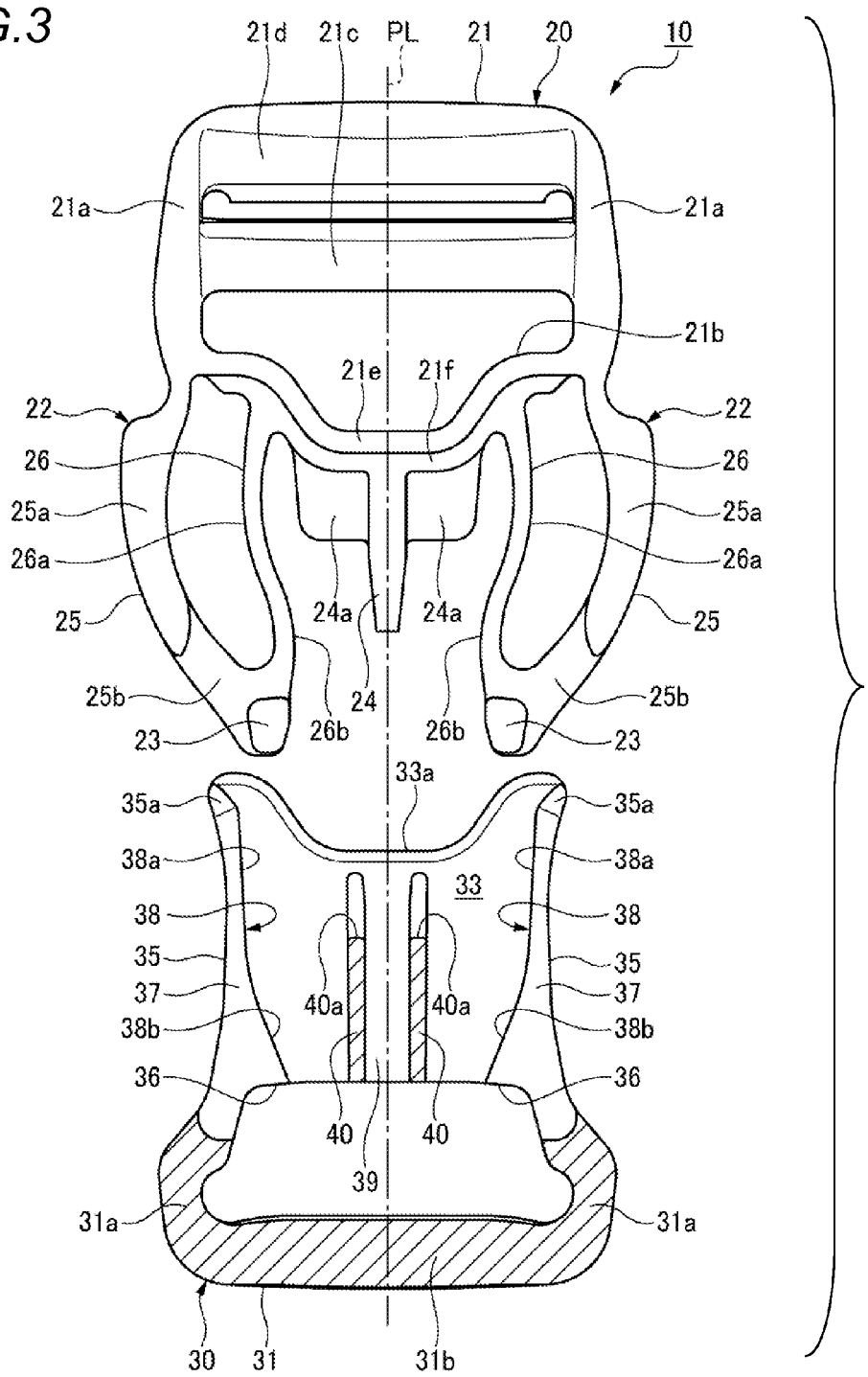
FIG. 3 is a partially cutaway plan view of the buckle at the disengaged state.
Figure 12:
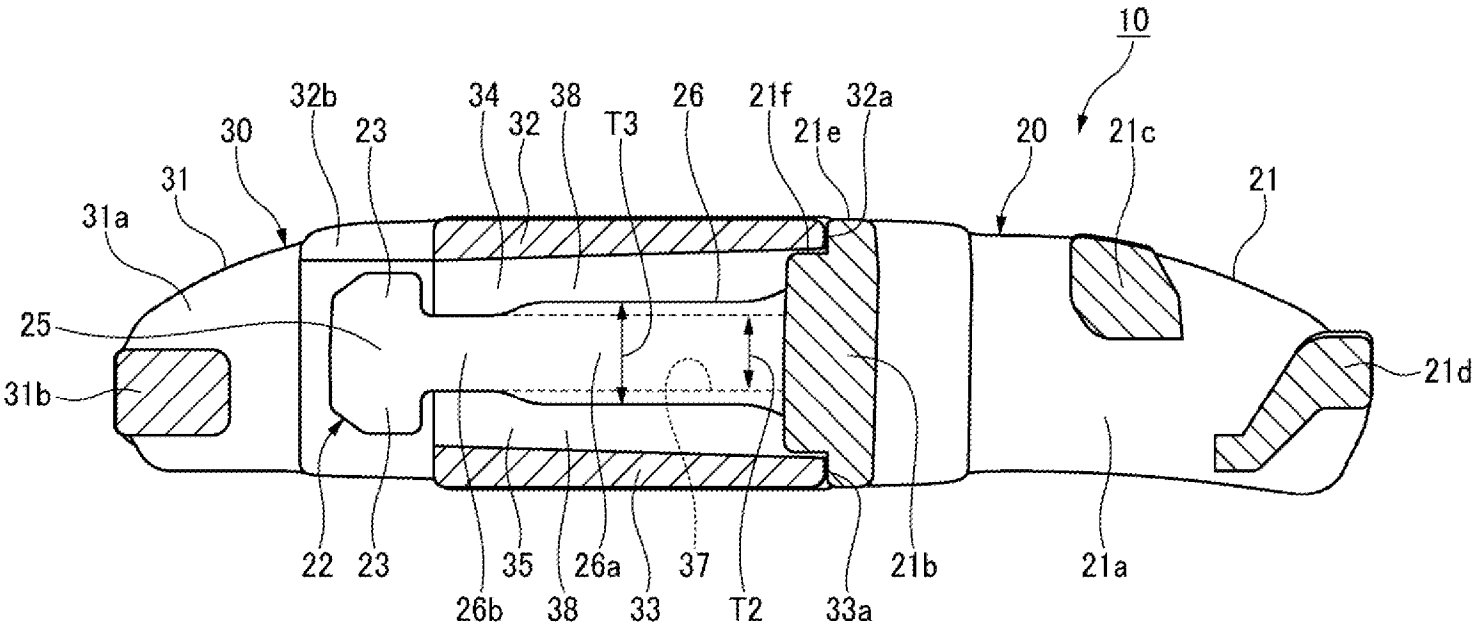
FIG. 12 is a sectional view taken along a line C-C of FIG. 9.

As shown in FIGS. 3, 7 and 12, the engagement stepped portions 36 are respectively formed at end portions of the inner surfaces of the upper side wall parts 34 and lower side wall parts 35, which end portions face the socket-side base part 31. Also, the engaged stepped portions 36 of the upper side wall parts 34 are covered by protruding pieces 32*b* extending from the upper plate 32 (refer to FIGS. 1 and 9).

As shown in FIGS. 3 and 7, the guide surfaces 38 are continuously formed from the end portions of the inner surfaces of the upper side wall parts 34 and lower side wall parts 35 at the plug insertion-side to the upper and lower engagement stepped portions 36, respectively. Also, the guide surface 38 has a linear part 38*a* formed from the end portion of the plug insertion-side to the intermediate part, and a constricted part 38*b* formed from the intermediate part to the engagement stepped portion 36 and curved so that a dimension between the right and left guide surfaces 38 in the width direction is gradually narrowed towards the engagement stepped portions 36. Also, the engagement stepped portions 36 may be formed at positions continuing to the guide surfaces 38 of the upper side wall parts 34 and lower side wall parts 35 of the socket 30 or at positions continuing to the constricted parts 38*b* of the guide surfaces 38 of the upper side wall parts 34 and lower side wall parts 35.

As shown in FIG. 4, a dimension T1 of the pair of engagement protrusions 23 of the leg parts 22 of the plug 20 in the upward and downward direction is set to be greater than a dimension T2 of each of the slits 37 of the socket 30. Thereby, the pair of engagement protrusions 23 of the right and left leg parts 22 comes into contact with and is guided by the guide surfaces 38 of the right and left upper side wall parts 34 and right and left lower side wall parts 35 of the socket 30. Then, the pair of guided engagement protrusions 23 of the right and left leg parts 22 is engaged with the right and left engagement stepped portions 36, respectively.

Figure 13:
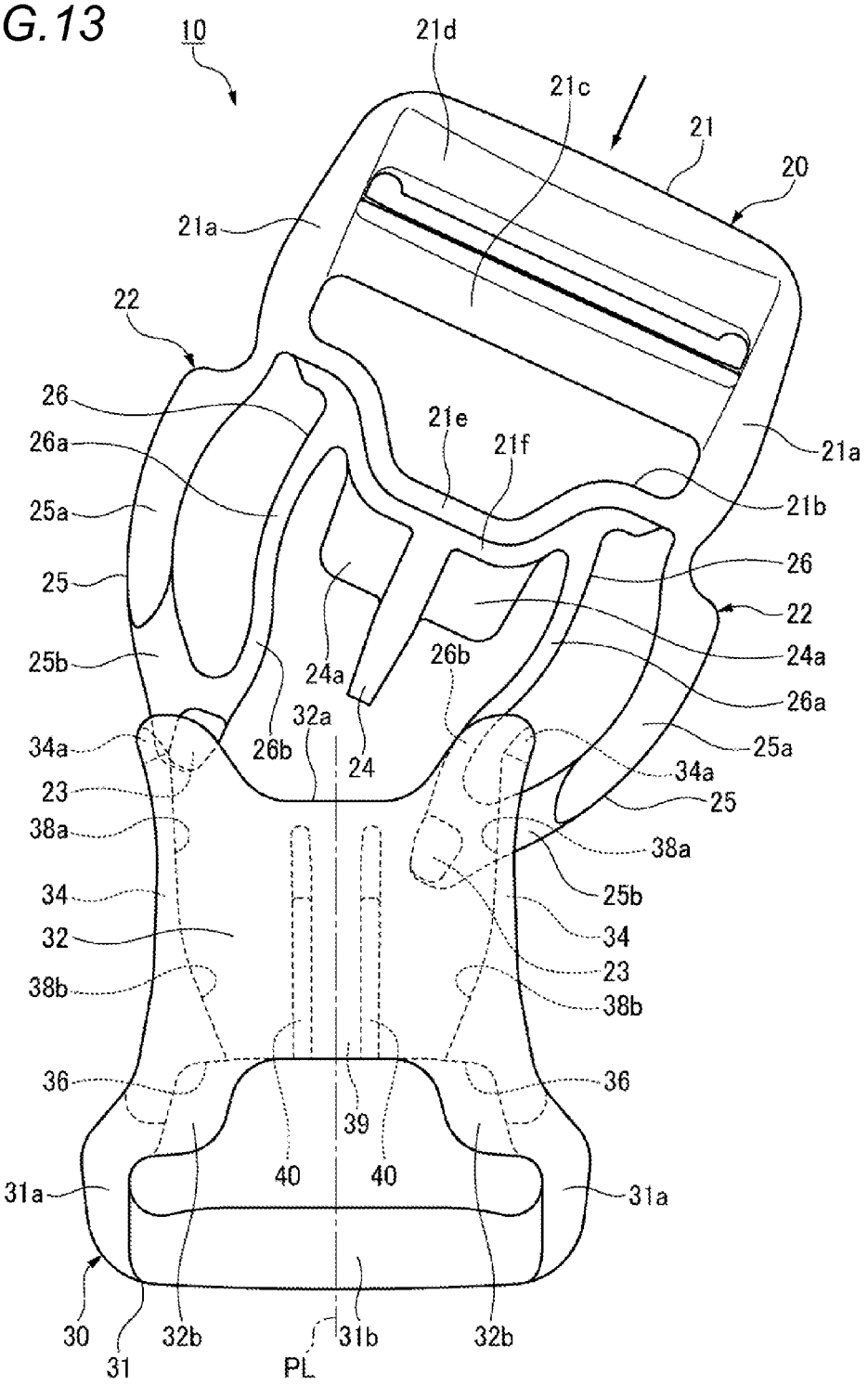
FIG. 13 is a plan view illustrating a state where a pair of engagement protrusions of a left leg part of the plug comes into contact with guide surfaces of an upper side wall part and a lower side wall part of the socket.

Further, as shown in FIG. 13, even if the plug 20 is inserted from the right obliquely relative to the plug insertion line PL, for example, since the pair of engagement protrusions 23 of the left leg part 23 of the plug 20 comes into contact with and guided by the guide surfaces 38 of the left upper side wall part 34 and left lower side wall part 35 of the socket 30, the direction of the plug 20 is adjusted to follow the plug insertion line PL.

Figure 14:
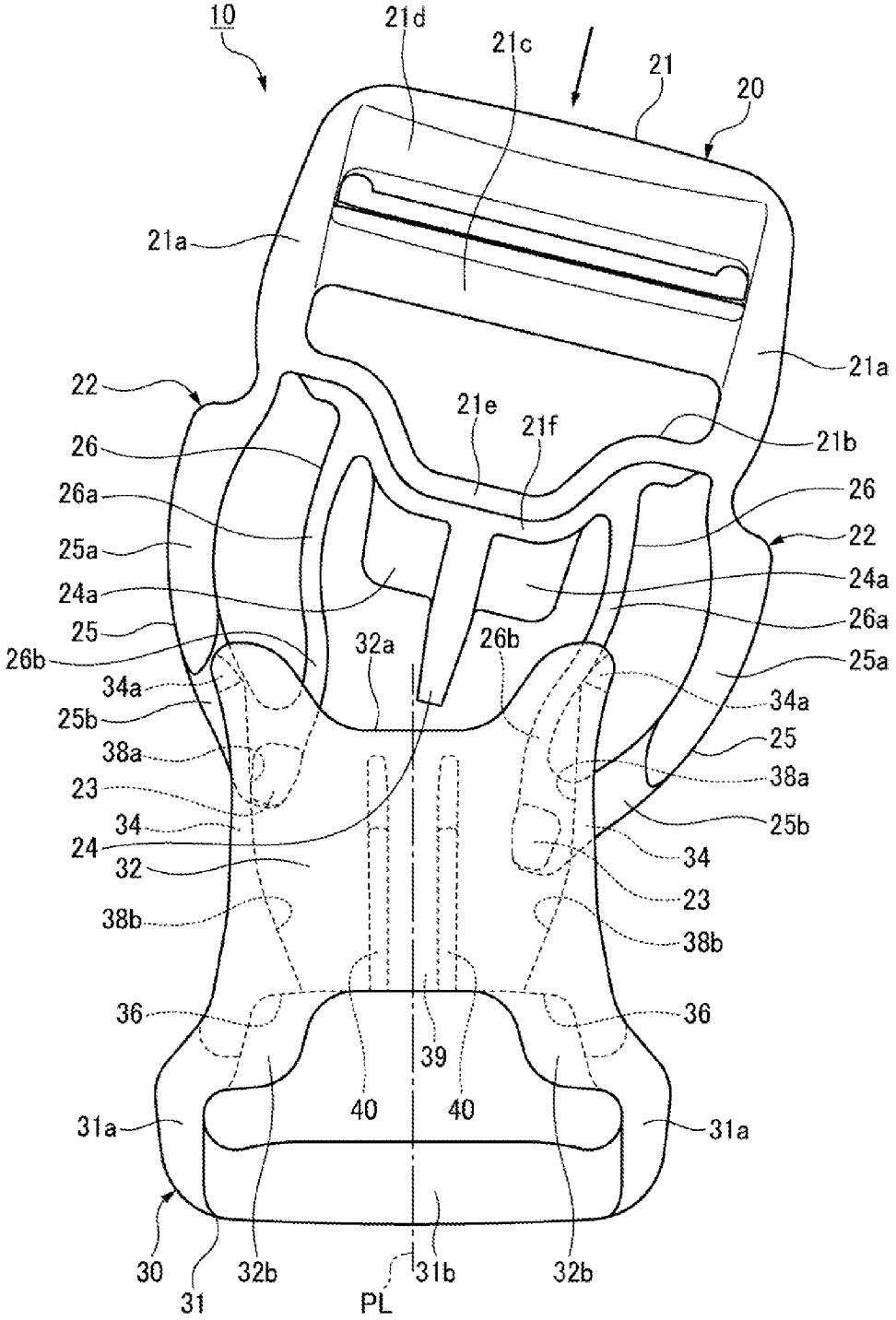
FIG. 14 is a plan view illustrating a state where an outer surface of an inner leg part of a right leg part of the plug comes into contact with end portions of the upper side wall part and lower side wall part of the socket.

Also, as shown in FIG. 12, a dimension T3 of the first curved part 26*a* of the inner leg part 26 of the plug 20 in the upward and downward direction is set to be greater than the dimension T2 of each of the slits 37 of the socket 30 in the width direction. Thereby, as shown in FIG. 14, even if the plug 20 is inserted from the right obliquely relative to the plug insertion line PL, for example, since an outer surface of the first curved part 26*a* of the right inner leg part 26 comes into contact with and guided by the end portions of the upper side wall part 34 and lower side wall part 35 of the socket 30, the direction of the plug 20 is further adjusted to follow the plug insertion line PL.

Figure 15:
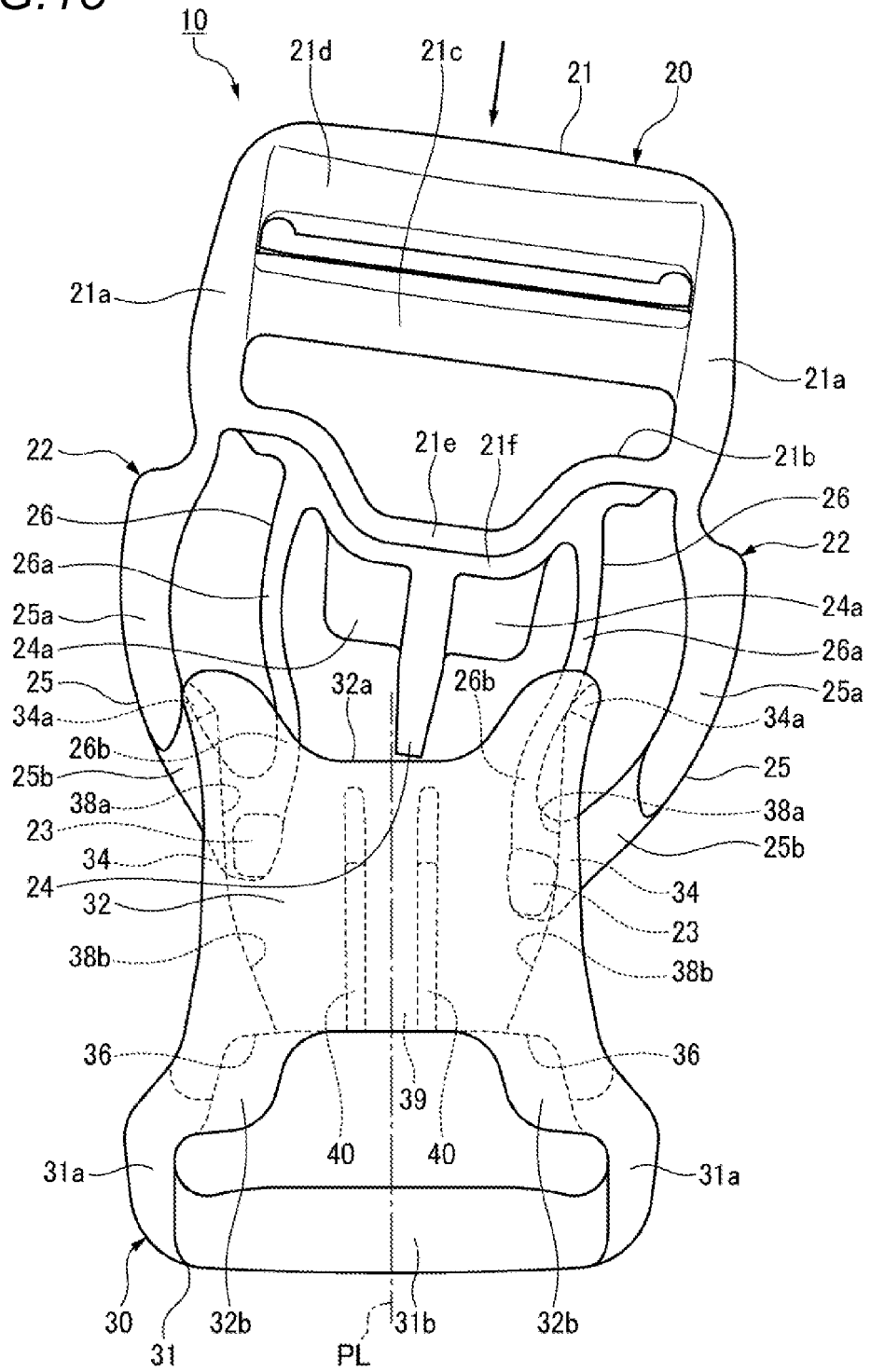
FIG. 15 is a plan view illustrating a state where an inner surface of an outer leg part of the left leg part of the plug comes into contact with outer surfaces of an upper plate and a lower plate of the socket.

Also, as shown in FIG. 4, a dimension T4 of the operation part 25*a* of the outer leg part 25 of the plug 20 in the upward and downward direction is set to be greater than a dimension T5 between the upper plate 32 and the lower plate 33 in the upward and downward direction. Thereby, as shown in FIG. 15, even if the plug 20 is inserted from the right obliquely relative to the plug insertion line PL, for example, since an inner surface of the operation part 25*a* of the left outer leg part 25 comes into contact with and is guided by the outer surfaces of the upper plate 32 and lower plate 33 of the socket 30, the direction of the plug 20 is further adjusted to follow the plug insertion line PL.

In this illustrative embodiment, the guidance by the engagement protrusions 23 of the leg parts 22 and the guide surfaces 38, the guidance by the first curved parts 26*a* of the inner leg parts 26 and the upper and lower side wall parts 34, 35 and the guidance by the operation parts 25*a* of the outer leg parts 25 and the upper and lower plates 32, 33 are continuously made by a series of insertion operations.

Figure 10:
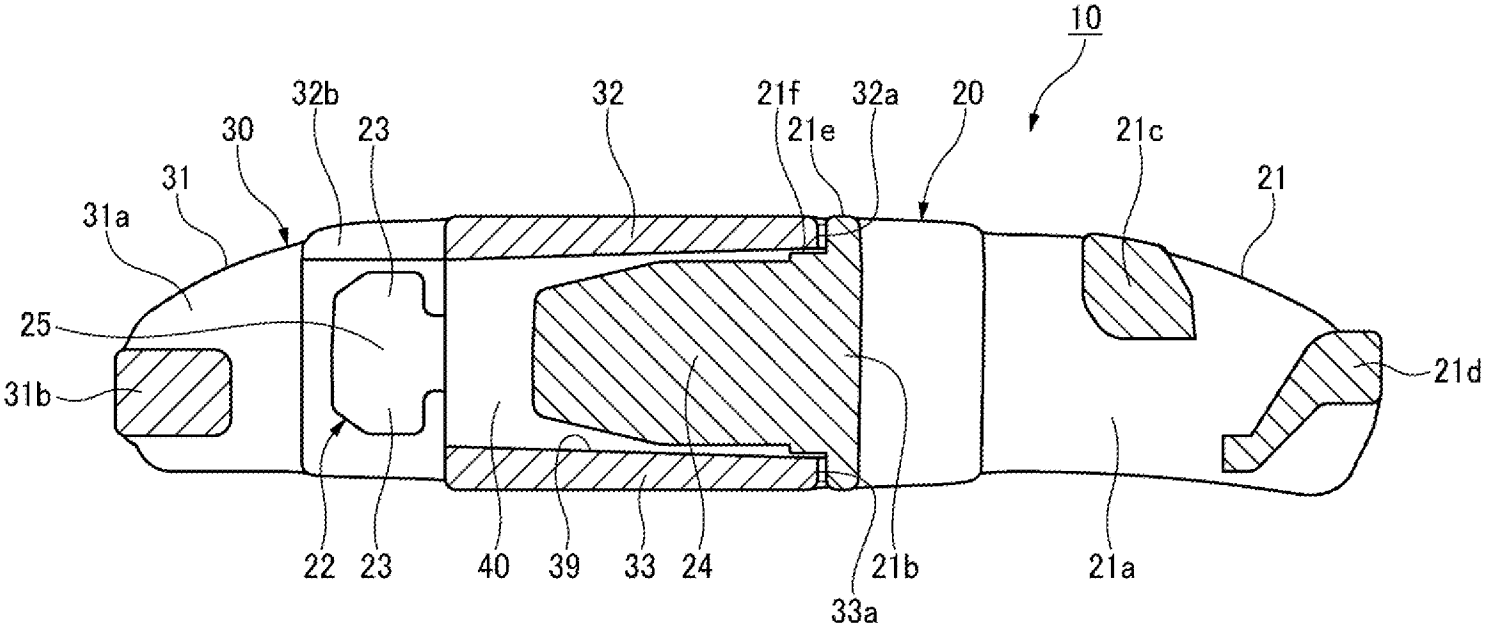
FIG. 10 is a sectional view taken along a line A-A of FIG. 9.
Figure 11:
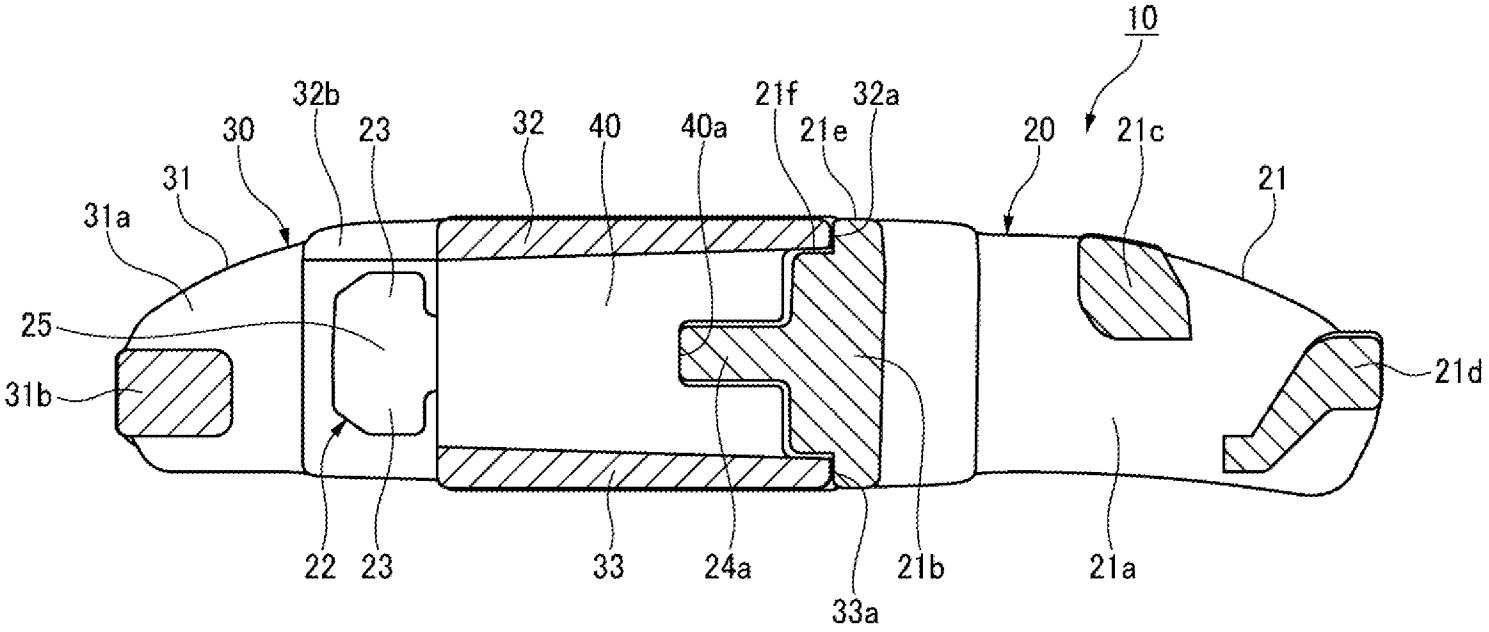
FIG. 11 is a sectional view taken along a line B-B of FIG. 9.

Also, as shown in FIGS. 10 to 12, the inner surfaces of the upper and lower plates 32, 33 of the socket 30 are formed to be gradually narrowed towards the socket-side base part 31. Thereby, since the end portions of the upper and lower plates 32, 33 at the plug insertion-side are widened, an insertion ability of the plug 20 is improved.

As shown in FIGS. 8 to 11, the fitting hole 39 is a hole having a rectangular section to which the fitting rod 24 can be inserted through a slight gap, and is configured by the upper and lower plates 32, 33 and a pair of right and left plate parts 40 formed to connect the upper and lower plates 32, 33. Also, end faces of the pair of right and left plate parts 40 at the plug insertion-side are formed with the concave parts 40*a* to which the right and left protruding pieces 24*a* of the fitting rod 24 are fitted.

Also, as shown in FIG. 9, the right and left inner leg parts 26 of the plug 20 are formed so that the outer surfaces thereof come into contact with the linear parts 38*a* of the right and left guide surfaces 38 of the socket 30. Thereby, when the plug is inserted, the right and left inner leg parts 26 comes into contact with and are guided by the right and left guide surfaces 38, respectively, so that the insertion ability of the plug 20 is improved. Also, upon the engagement of the buckle, since the right and left inner leg parts 26 come into contact with the right and left guide surfaces 38, respectively, the rattling of the plug 20 and the socket 30 in the width direction is prevented.

Also, as shown in FIG. 9, a maximum dimension L1 of the operation parts 25*a* of the right and left leg parts 22 of the plug 20 in the width direction is set to be greater than a maximum dimension L2 of the plug-side base part 21 of the plug 20 in the width direction and a maximum dimension L3 of the socket-side base part 31 of the socket 30 in the width direction. Thereby, since the right and left operation parts 25*a* are arranged at the outer sides of the plug-side base part 21 and the socket-side base part 31 in the width direction, it is possible to easily find the right and left operation parts 25*a* even if a user gropes for the operation parts. Also, since it is possible to easily press inwards the right and left operation parts 25*a* with a gloved hand or finger, the operability of the buckle 10 is improved.

As described above, according to the buckle 10 of this illustrative embodiment, the dimension T1 of the pair of engagement protrusions 23 of the leg parts 22 of the plug 20 in the upward and downward direction is set to be greater than the dimension T2 of each of the slits 37 of the socket 30 in the width direction. Therefore, even if the plug 20 is inserted obliquely relative to the plug insertion line PL, the pair of engagement protrusions 23 of the one leg part 22 of the plug 20 comes into contact with and is guided by the guide surfaces 38 of the upper side wall part 34 and lower side wall part 35 of the socket 30. Thereby, since the direction of the plug 20 is adjusted to follow the plug insertion line PL, it is possible to easily insert the plug 20 into the socket 30.

Also, according to the buckle 10 of this illustrative embodiment, the dimension T3 of the first curved part 26*a* of the inner leg part 26 of the plug 20 in the upward and downward direction is set to be greater than the dimension T2 of each of the slits 37 of the socket 30 in the width direction. Therefore, even if the plug 20 is inserted obliquely relative to the plug insertion line PL, the outer surface of the first curved part 26*a* of the one inner leg part 26 of the plug 20 comes into contact with and is guided by the end portions of the upper side wall part 34 and lower side wall part 35 of the socket 30. Thereby, since the direction of the plug 20 is further adjusted to follow the plug insertion line PL, it is possible to further easily insert the plug 20 into the socket 30.

Also, according to the buckle 10 of this illustrative embodiment, the dimension T4 of the operation part 25*a* of the outer leg part 25 of the plug 20 in the upward and downward direction is set to be greater than the dimension T5 between the upper and lower plates 32, 33 in the upward and downward direction. Therefore, even if the plug 20 is inserted obliquely relative to the plug insertion line PL, the inner surface of the operation part 25*a* of the one outer leg part 25 of the plug 20 comes into contact with and is guided by the outer surfaces of the upper plate 32 and lower plate 33 of the socket 30. Thereby, since the direction of the plug 20 is further adjusted to follow the plug insertion line PL, it is possible to further easily insert the plug 20 into the socket 30.

Also, according to the buckle 10 of this illustrative embodiment, the plug 20 has the fitting rod 23 arranged between the pair of leg parts 22 and formed in parallel with the pair of leg parts 22, and the socket 30 has the fitting hole 39 arranged between the upper and lower plates 32, 33 and to which the fitting rod 24 is fitted. Therefore, upon the engagement of the buckle, it is possible to prevent the plug 20 and the socket 30 from rattling in the upward and downward direction and in the width direction.

Also, according to the buckle 10 of this illustrative embodiment, the inner surfaces of the upper and lower plates 32, 33 of the socket 30 are formed to be gradually narrowed towards the socket-side base part 31. Therefore, it is possible to widen the end portions of the upper and lower plates 32, 33 at the plug insertion-side, so that it is possible to improve the insertion ability of the plug 20.

Also, according to the buckle 10 of this illustrative embodiment, the right and left inner leg parts 26 of the plug 20 are formed so that the outer surfaces thereof come into contact with the linear parts 38*a* of the right and left guide surfaces 38 of the socket 30. Therefore, upon the insertion of the plug 20, since the right and left inner leg parts 26 come into contact with and are guided by the right and left guide surfaces 38, it is possible to improve the insertion ability of the plug 20. Also, upon the engagement of the buckle, since the right and left inner leg parts 26 come into contact with the right and left guide surfaces 38, respectively, it is possible to prevent the plug 20 and the socket 30 from rattling in the width direction.

Also, according to the buckle 10 of this illustrative embodiment, the maximum dimension L1 of the operation parts 25*a* of the right and left leg parts 22 of the plug 20 in the width direction is set to be greater than the maximum dimension L2 of the plug-side base part 21 of the plug 20 in the width direction and the maximum dimension L3 of the socket-side base part 31 of the socket 30 in the width direction. Therefore, the right and left operation parts 25*a* are arranged at the outer sides of the plug-side base part 21 and the socket-side base part 31 in the width direction. Thereby, it is possible to easily find the right and left operation parts 25*a* even if the user gropes for the operation parts. Also, since it is possible to easily press inwards the right and left operation parts 25*a* with a gloved hand or finger, it is possible to improve the operability of the buckle 10.

Also, according to the buckle 10 of this illustrative embodiment, the end portion of the slit 37 of the socket 30 at the plug insertion-side is opened and the operation parts 25*a* of the outer leg parts 25 of the plug 20 are arranged at the outer sides of the side edges of the upper and lower plates 32, 33 in the width direction. Therefore, it is possible to release the engagement of the buckle 10 by two methods, i.e., a method where the user grips the socket 30 with one hand and pushes in the left and operation parts 25*a* with the other hand to pull out the plug 20 from the socket 30 and a method where the user pushes in and forces out the right and left operation parts 25*a* with one hand to separate the plug 20 from the socket 30.

Also, according to the buckle 10 of this illustrative embodiment, the operation parts 25*a* of the outer leg parts 25 of the plug 20 are arranged at the outer sides of the side edges of the upper and lower plates 32, 33 in the width direction. Therefore, even when the size of the buckle 10 is reduced, it is possible to keep the operability. In the meantime, specifically, it is possible to easily operate even a buckle to which a belt having a width of 8 mm is attached.

Also, according to the buckle 10 of this illustrative embodiment, since the end portion of the slit 37 of the socket 30 at the plug insertion-side is opened, the end portion of the socket 30 at the plug insertion-side is not annularly formed. Thereby, it is possible to shorten an entire length of the socket 30, as the configuration where the socket is not annularly formed, so that it is possible to shorten an entire length of the buckle 10. Also, as compared to a configuration where the socket is annularly formed, it is possible to more widen the insertion angle of the plug 20 relative to the plug insertion line PL.

In the meantime, the present invention is not limited to the above illustrative embodiment and can be appropriately changed without departing from the scope of the present invention.

DESCRIPTION OF REFERENCE NUMERALS

10 Buckle
20 Plug
21 Plug-Side Base Part
22 Leg Part
23 Engagement Protrusion
24 Fitting Rod
25 Outer Leg Part
25*a* Operation Part
26 Inner Leg Part
26*a* First Curved Part
26*b* Second Curved Part
30 Socket
31 Socket-Side Base Part
32 Upper Plate
33 Lower Plate
34 Upper Side Wall Part
35 Lower Side Wall Part
36 Engagement Stepped Portion
37 Slit
38 Guide Surface
39 Fitting Hole
PL Plug Insertion Line
T1 Dimension of Pair of Engagement Protrusions in Upward and Downward Direction
T2 Dimension of Slit in Width Direction T3 Dimension of First Curved Part of Inner Leg Part in Upward and Downward Direction T4 Dimension of Operation Part of Outer Leg Part in Upward and Downward Direction T5 Dimension between Upper and Lower Plates in Upward and Downward Direction

The invention claimed is:

1. A buckle comprising:

a plug; and a socket configured to be engaged with the plug, wherein the plug comprises:

a plug-side base part to which a belt-shaped member is attached;

a pair of leg parts extending in parallel with each other from both end portions of the plug-side base part in a width direction; and a pair of engagement protrusions protruding in an upward and downward direction from each of leading end portions of the pair of leg parts, wherein the socket comprises:

a socket-side base part to which the belt-shaped member is attached;

an upper plate and a lower plate extending from the socket-side base part;

upper side wall parts protruding downwardly along both side edges of the upper plate in the width direction;

lower side wall parts protruding upwardly along both side edges of the lower plate in the width direction;

engagement stepped portions capable of being respectively engaged with the pair of engagement protrusions of the pair of leg parts inserted between the upper and lower plates;

slits formed between the upper side wall parts and the lower side wall parts and each having an end portion opened at a plug insertion-side so that the pair of leg parts can be inserted therein; and guide surfaces formed on inner surfaces of the upper side wall parts and the lower side wall parts and configured to guide the pair of engagement protrusions of the pair of leg parts inserted between the upper and lower plates to the engagement stepped portions, wherein when the plug is inserted into the socket, the engagement protrusions of the leg parts of the plug comes into contact with and are guided by the guide surfaces of the socket, wherein the plug comprises a fitting rod arranged between the pair of leg parts and formed in parallel with the pair of leg parts, wherein the socket comprises a fitting hole arranged between the upper and lower plates and into which the fitting rod is fitted, wherein protruding pieces are formed at central portions of both side surfaces of the fitting rod in the upward and downward direction, wherein the fitting hole is configured by the upper plate, the lower plate, and a pair of right and left plate parts formed so as to connect to the upper plate and the lower plate, and wherein end faces of the pair of right and left plate parts at the plug insertion-side are formed with concave parts to which the protruding pieces are fitted.

2. The buckle according to claim 1, wherein each of the leg parts has an outer leg part and an inner leg part, and wherein an outer surface of the inner leg part is configured to come into contact with and be guided by the upper side wall part and lower side wall part of the socket.

3. The buckle according to claim 2, wherein when the plug is inserted into the socket, a guidance by the engagement protrusions of the leg parts of the plug and the guide surfaces of the socket, a guidance by outer surfaces of the inner leg parts and the upper side wall parts and lower side wall parts of the socket, and a guidance by inner surfaces of the outer leg parts of the plug and outer surfaces of the upper plate and lower plate of the socket are continuously made.

4. The buckle according to claim 1, wherein each of the leg parts has an outer leg part and an inner leg part, and wherein an inner surface of the outer leg part is configured to come into contact with and be guided by outer surfaces of the upper plate and lower plate of the socket.

5. The buckle according to claim 4, wherein when the plug is inserted into the socket, a guidance by the engagement protrusions of the leg parts of the plug and the guide surfaces of the socket, a guidance by outer surfaces of the inner leg parts and the upper side wall parts and lower side wall parts of the socket, and a guidance by inner surfaces of the outer leg parts of the plug and outer surfaces of the upper plate and lower plate of the socket are continuously made.

* * * * *